United States Patent [19]

Lienard

[11] Patent Number: 5,072,673

[45] Date of Patent: Dec. 17, 1991

[54] BOGIE WITH A DEFORMABLE UNDERFRAME INCLUDING AN OBLIQUE FACED FRICTION WEDGE AND DIRECT ENGAGEMENT BETWEEN BOLSTER AND SIDE-FRAME

[75] Inventor: Jean Lienard, Ferriere la Petite, France

[73] Assignee: Usines et Acieries de Sambre et Meuse, Feignies, France

[21] Appl. No.: 495,591

[22] Filed: Mar. 19, 1990

[30] Foreign Application Priority Data

Mar. 24, 1989 [FR] France ..... 89 03902

[51] Int. Cl.[5] ..... B61F 5/50

[52] U.S. Cl. ..... 105/198.2; 105/198.4; 267/134; 267/196

[58] Field of Search ..... 105/197.05, 198.2, 198.4, 105/198.5, 208, 208.1, 222, 226; 267/6, 134, 136, 196, 214, 216

[56] References Cited

U.S. PATENT DOCUMENTS

| | | | |
|---|---|---|---|
| 1,868,529 | 4/1932 | Harbison | 105/197.05 |
| 2,352,693 | 7/1944 | Davidson | 105/198.2 |
| 2,697,989 | 12/1954 | Shafer | 105/198.2 |
| 2,702,512 | 2/1955 | Maatman | 105/198.4 |
| 2,723,630 | 11/1955 | Settles | 105/198.2 |
| 2,853,958 | 9/1958 | Neumann | 105/198.2 |
| 3,079,873 | 3/1963 | Tack et al. | 105/206.1 |
| 3,254,613 | 6/1966 | Weber | 105/198.2 |
| 3,261,305 | 7/1966 | Shafer | 105/198.2 |
| 3,450,063 | 6/1969 | Shafer | 105/198.2 |
| 3,670,660 | 6/1972 | Weber et al. | 105/222 X |
| 3,844,226 | 10/1974 | Brodeur et al. | 105/222 |
| 4,084,514 | 4/1978 | Bullock | 105/198.4 |
| 4,244,298 | 1/1981 | Hawthorne et al. | 105/198.4 |
| 4,357,880 | 11/1982 | Weber | 105/197.05 |
| 4,574,708 | 3/1986 | Solomon | 105/198.2 X |

FOREIGN PATENT DOCUMENTS 2453765 11/1980 France .

*Primary Examiner*—Robert J. Oberleitner
*Assistant Examiner*—S. Joseph Morano
*Attorney, Agent, or Firm*—Young & Thompson

[57] ABSTRACT

The bogie has two side-frames. Each side-frame has an opening in which a respective end of a bolster bar rests upon the side-frame by way of suspension springs. Two wedges, themselves supported by springs and having an oblique face which is thereby pressed against an oblique face of the bolster, consequently assume a friction bearing against a frictional face of the side-frame so as to damp the suspension oscillations. The oblique faces are not only oblique with respect to the vertical, but also with respect to the longitudinal midline of the bogie. The horizontal force to which the wedge is subjected consequently comprises a transverse component which is used to clamp the side-frame between the wedge and a reference face of the bolster. The transverse component thus stabilizes the side-frames in a position orthogonal to the bolster, thereby counteracting forward and backward movements of one side-frame with respect to the other, while allowing for independent movements of the side-frames in their respective vertical plane to absorb rail bed irregularities.

9 Claims, 5 Drawing Sheets

BOGIE WITH A DEFORMABLE UNDERFRAME INCLUDING AN OBLIQUE FACED FRICTION WEDGE AND DIRECT ENGAGEMENT BETWEEN BOLSTER AND SIDE-FRAME

The present invention relates to a bogie with a deformable underframe.

The present invention also relates to a method for improving a bogie with a deformable underframe, as well as a set of interchangeable parts for implementing the method.

Such bogies generally comprise two sole bars or side frames, between which extend at least two axles on which bear the sole bars, and at least one transom or bolster which receives the weight of the vehicle supported by the bogie. The transom bears at each of its ends on one of the sole bars.

In railroad units with a deformable underframe, the two sole bars may be displaced independently of each other, in particular in the vertical plane. This enables the bogies to travel on tracks in a very poor condition without the underframe undergoing excessive stresses and without there being any risk of the wheels losing contact with the railroad track.

In order to enable these relative displacements between the two sole bars, each end of the transom is connected to the associated sole bar by a deformable Moreover, the ends of the axles may have a certain freedom of movement relative to the sole bars.

U.S. Pat. No. 2,352,693, 2,723,630, 3,079,873, 3,254,613, 3,261,305, 3,450,063 and 4,084,514 disclose an arrangement in which the sole bars form part of the non-suspended masses, in other words the elastic suspension device is placed inbetween each transom end and the associated sole bar. The transom end is engaged in a cage formed in the sole bar and rests against a lower face of the cage via compression springs. In order to damp the vertical oscillations, wedges pushed by springs are placed inbetween the front and rear lateral faces of the transom ends and the corresponding lateral faces of the cages. When the transom end oscillates vertically in the cage, the front wedge and the rear wedge associated with each end oscillate with it and rub against the abovementioned lateral faces of the cage which are substantially transverse to the direction of running, which causes a damping effect.

In bogies of this type, it is impossible to prevent completely the transom from pivoting in the horizontal plane relative to the sole bars, with the result that the sole bars are not prevented from. having degrees of longitudinal movement relative to each other. Consequently, when traveling in a straight line, the axles are not held strictly perpendicular to the direction of travel. This is a serious problem which causes the traveling speed of this type of equipment to be limited. Apart from the limited speed, there is a risk of a rocking motion appearing which is capable of being amplified uncontrollably and causing a derailment. The transom, on which the load rests, furthermore has a degree of play in its lengthwise direction relative to the sole bars, and this play enables the load to move laterally and causes lateral impacts on the sole bars which tend to destabilize the bogie. All of these degrees of play increase with wear.

FR-A No. 2,453,765 and U.S. Pat. No. 4,244,298 and 4,574,708 disclose devices with wedges guided between two opposite vertical faces and pressed against a face with two inclined planes, in other words a face which is oblique when seen in elevation and when seen from above. The purpose of the latter is to stabilize the wedges in order to prevent their rocking motions which correspond to pivoting motions of the transom in a plane horizontal relative to the sole bars. Not only do these known arrangements achieve their result in a considerably less than perfect manner, but they do prevent the transom from being displaced parallel to its length relative to the sole bars, at least within certain limits.

The transom of the bogie according to U.S. Pat. No. 2,853,958 comprises, at each end on its two opposite vertical faces, two V-shaped notches, one of the faces of which is stationary and the other defined by a wedge arranged obliquely. The opposite vertical sides of the cage of each sole bar have a V-shaped profile which complements that of each notch. Each wedge bears against one of the other face of the V-shaped profile against the stationary face of the corresponding notch. The stationary faces of the V-shaped notches thus form reference faces, from which the sole bar may only move away if it overcomes the force threshold defined by the springs stressing the wedges. The longitudinal forces which are exerted on the sole bar are, however, transmitted to the transom via the faces of the V-shaped profile, and therefore with a cam effect which tends to destabilize the bogie. Furthermore, the wedges must be guided in slides in the transom, where there is a risk of them experiencing friction. Lastly, the sole bar in this document, with its V-shaped sides, does not correspond to current standards, which makes it very complicated to put this unit into service.

The object of the invention is to increase the speed and force threshold above which the bogie is likely to be deformed unfavorably and to become destabilized.

The subject of the invention is thus, according to a first aspect, a bogie comprising two longitudinal elements, such as sole bars, between which extend axles and at least one transverse element such as a transom, the transverse element forming, at each of its ends together with one of the longitudinal elements and a wedge, a deformable link in which:

a lateral reference face of the longitudinal element bears laterally, with the possibility of vertical friction, against a mating reference face belonging to the transverse element, these reference faces being transverse to the longitudinal direction of the transverse element;

the wedge has an oblique face which is so oriented that a vertical plane orthogonally intersecting said oblique face forms an angle with a longitudinal midplane of the bogie, and which is urged by elastic means against a friction bearing between vertical friction faces belonging to the wedge and to the other longitudinal and transverse element respectively, and on the other hand, as a result of a reaction force, the abovementioned lateral bearing between the reference faces, which friction faces and reference faces have a relative vertical motion in the event of relative vertical motion between the longitudinal element and the transverse element of the link.

According to the first aspect of the invention, the friction faces of the bogie number two on the wedge and two on said other element, these friction faces being arranged in a dihedron with a substantially vertical ridge and comprising a side transverse to the mid plane and a side substantially parallel to the mid plane.

By means of its V-shaped friction faces, the wedge positions itself relative to said other element having complementary V-shaped faces. There is therefore no longer any need to guide the wedge in a slide. In addition, these V-shaped faces, as distinct from the oblique face of U.S. Pat. No. 2,853,958, no longer create a cam effect between the longitudinal and transverse elements.

The edge of the dihedron which is parallel to the mid plane transmits a force which applies the reference face of the longitudinal element against the reference face of the transverse element.

According to a second aspect of the invention, in the method for improving a bogie comprising two longitudinal elements, such as sole bars/between which extend axles and at least one transverse element such as a transom, the transverse element forming, at each of its ends together with one of the longitudinal elements and a wedge, a deformable link in which, under the action of elastic means, an oblique face of the wedge bears against a corresponding oblique face of the transverse element of the link, so as to generate a friction bearing between vertical friction faces of the wedge and of the longitudinal element:

the transverse element is replaced by a transverse element having for each link a vertical transverse reference face provided with a friction lining and an oblique face which is oblique with respect to a longitudinal direction of the transverse element;

the wedges are replaced by wedges having two friction faces forming an angle with each other and an oblique face which is so oriented with respect to the friction faces that a plane orthogonally intersecting the wedge oblique face and extending parallel to an intersection line of the friction faces, is oblique relative to the two friction faces; and friction linings are placed on each side of the longitudinal element along a vertical side of a cage intended to receive the transom end.

The invention may thus be applied to an existing bogie, replacing on it only a minimum number of parts (corresponding to approximately 15% of the value of a new bogie).

According to a third aspect of the invention, the set of interchangeable parts for implementing the method comprises:

a transverse element having, on at least one side of each end, a vertical transverse reference face provided with a friction lining and an oblique face, which is oblique with respect to a longitudinal direction of said transverse element;

wedges having two friction faces forming an angle with each other and an oblique face which is so oriented that a plane orthogonally intersecting the oblique face and extending parallel to an intersection line of the two friction faces is oblique with respect to the two friction faces.

Other features and advantages of the invention will emerge from the description hereinbelow.

In the attached drawings, given by way of non-limiting examples:

Figure 1:
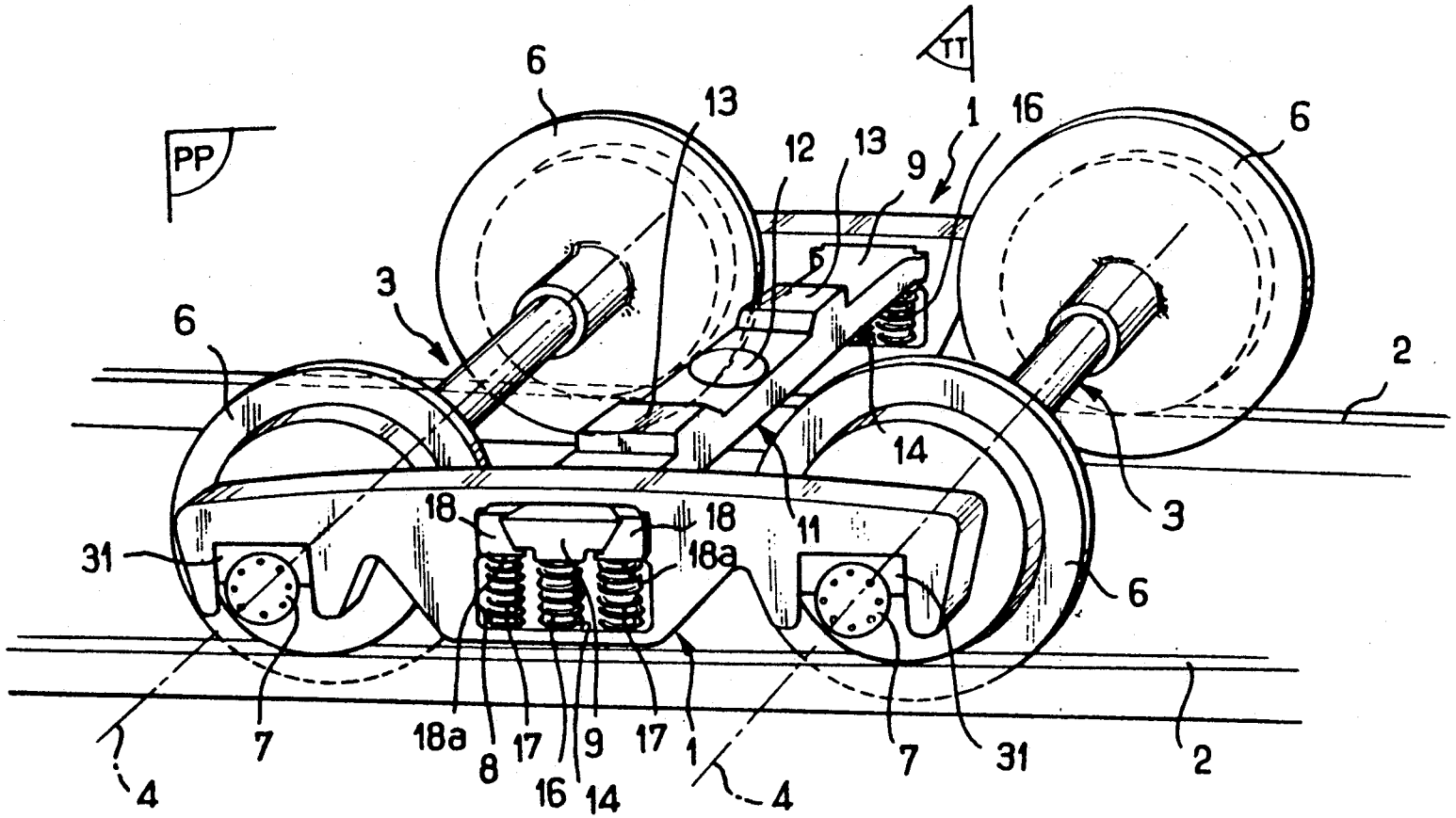
FIG. 1 is a schematic perspective view of a bogie according to the invention.
Figure 3:
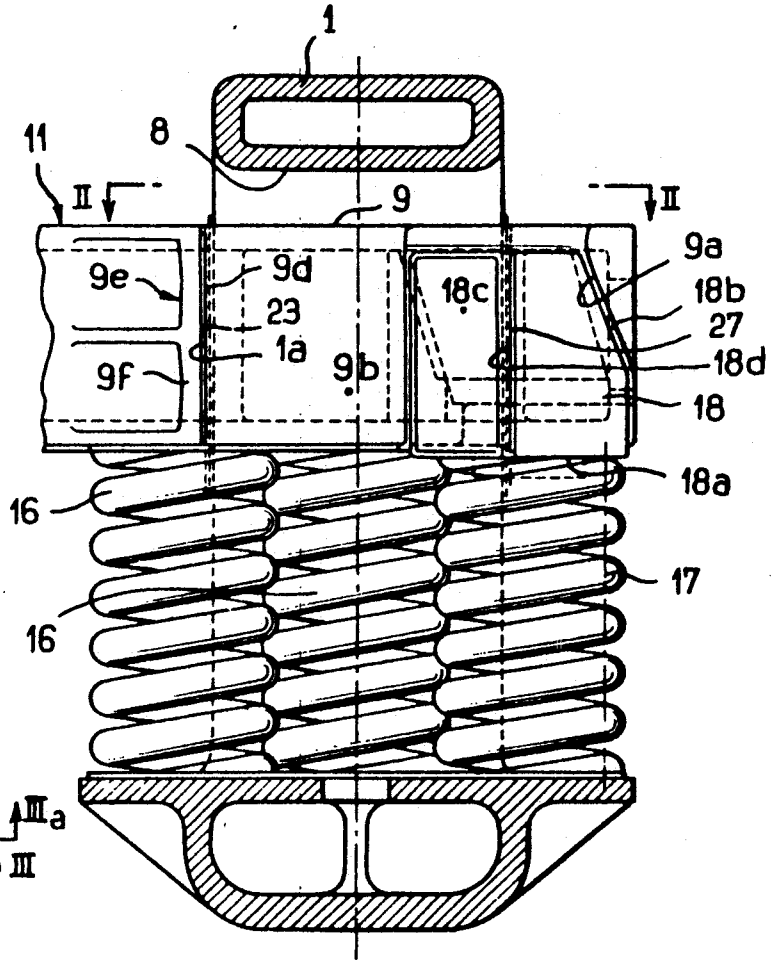
FIG. 3 is a view in cross-section along the line III—III in FIG. 2, the sole bar, however, being sectioned along the line III*a*-III*a* in FIG. 2.

In the example shown in FIG. 1, the bogie comprises an underframe comprising two lateral sole bars 1 whose general longitudinal direction is, when at rest, parallel to the rails 2 and to a longitudinal vertical mid plane PP of the bogie, situated halfway between the rails 2. In what follows, it will be assumed that the two rails 2 are in the same plane, and any line parallel to the plane defined by the two rails 2 will be qualified as horizontal, and any line perpendicular to this plane as vertical.

The two sole bars 1 are supported by two axles 3, the axis 4 of which is perpendicular to the plane PP. The axles 3 are arranged symmetrically about a transverse vertical mid plane TT of the bogie. Between the sole bars 1, each axle 3 carries two wheels 6. Beyond each wheel 6, the axles 3 have an axial extension supported by a bearing 7 on which the sole bar rests via a cap 31 which is simply positioned on the bearing 7.

At the center of its length, each sole bar 1 has an opening or cage 8, with a rectangular general shape, into which one of the ends 9 is engaged of a transom 11 which is parallel to the axles 3 when the bogie is at rest and the vertical mid plane of which is the transverse vertical mid plane TT of the bogie. The transom 11 is therefore situated halfway between the axles 3.

At the center of its length, the transom 11 has, on its upper face, a joint 12 onto a vertical axis (which is shown only schematically), for articulating a wagon, supported by the bogie, with the underframe. On either side of the joint 12, the transom 11 has bearing flanges 13 which support the weight of the wagon slidably.

The weight of the wagon is transmitted to the sole bars 1 by each transom end 9 which bears against a lower face 14 of the corresponding cage 8 via suspension springs 16, 17.

The springs 16, which number six in the example under each transom end (see FIG. 2), bear directly against the lower face of the transom end.

The suspension springs 17 number two for each transom end. They each bear against the lower face 18*a* (FIGS. 1 and 4) of a respective wedge 18. At each transom end 9, each of the two wedges 18 bears slidably with an oblique face 18*b* (FIG. 5) against an oblique face with a corresponding incline 9*a* of the end 9 of the transom 11, and with a first friction face 18*c* (see the right-hand part of FIG. 4) against a corresponding first friction face 8*a* of the cage 8.

The oblique faces 9*a* of the transom are arranged laterally on the transom end 9 and converge towards the bottom. They are defined by sliding linings 19. The first friction faces 18*c*, 8*a* are perpendicular to the running direction of the bogie (direction of the rails They are defined by friction linings 21, integral with the wedges 18, and 22 integral with the sole bar 1 respectively. The linings 22 are fastened against the substantially vertical opposite lateral faces of the cage 8.

Figure 4:
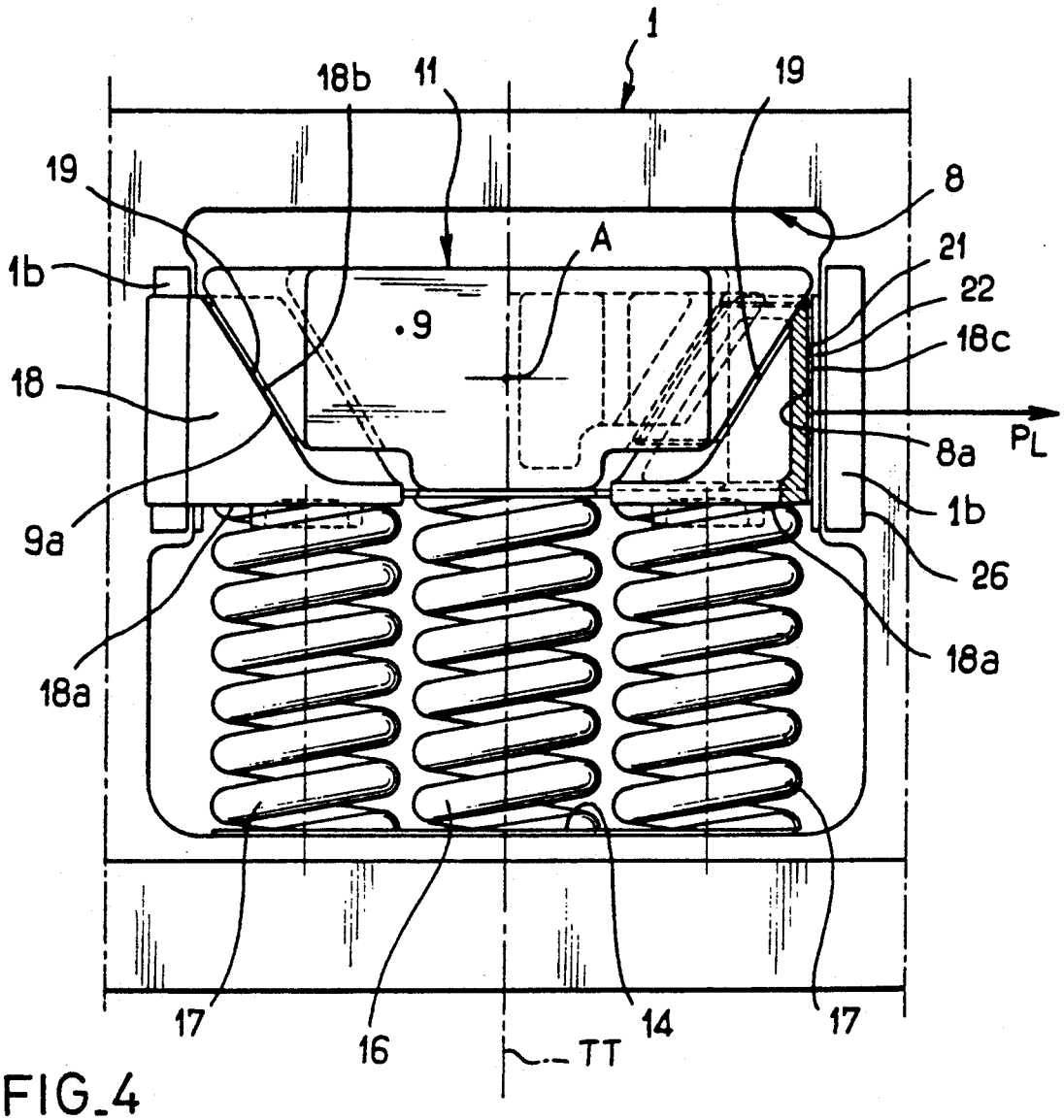
FIG. 4 is a view in the direction of the arrow IV in FIG. 2, but with a partial cross-section of one of the wedges along the line IV*a*-IV*a* in FIG. 2.
Figure 5:
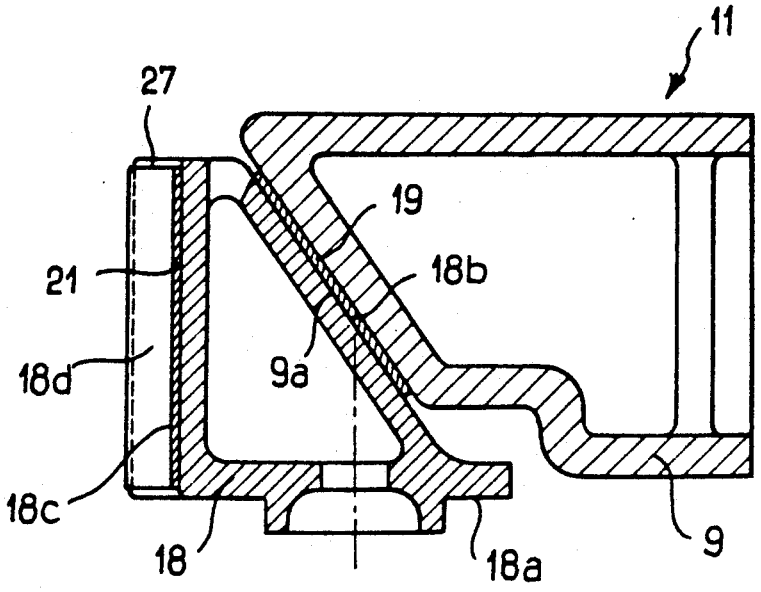
FIG. 5 is a view in cross-section along the line V—V in FIG. 2.

As shown in FIG. 4, the arrangement is symmetrical about the transverse vertical mid plane TT and, for the sake of explanatory ease, each transom end 9 is taken to be connected to the associated sole bar 1 by two deformable links situated on either side of the plane TT and each comprising in particular one of the wedges 18.

These links are qualified as deformable since they enable the end 9 of the transom to be displaced vertically in the cage 8 with friction between the first friction faces 18*c* and 8*a*. This friction, intended to damp the oscillations of the transom 9 in the cage 8 results from the pressure which the springs 17 exert upwards on the wedges 18. The sliding bearing between the oblique faces 18*b* of the wedge 18 and 9*a* of the lining 19 transforms this pressure of the springs 17 into a horizontal pressure $P_L$ directed in the longitudinal direction of the sole bars 1. The pressure $P_L$ applies the first friction face 18*c* of each wedge 18 against the first friction face 8*a* of the cage 8.

The movements of the transom 11 relative to the sole bar 1 may be vertical translational movements, rotational movements about a horizontal axis parallel to the direction of travel, or alternatively a combination of these two movements. The deformable link also enables the transom to pivot about a horizontal transverse axis such as the axis A (FIG. 4). This is necessary for the sole bars to be able to orient themselves independently of each other in their respective vertical plane.

Figure 2:
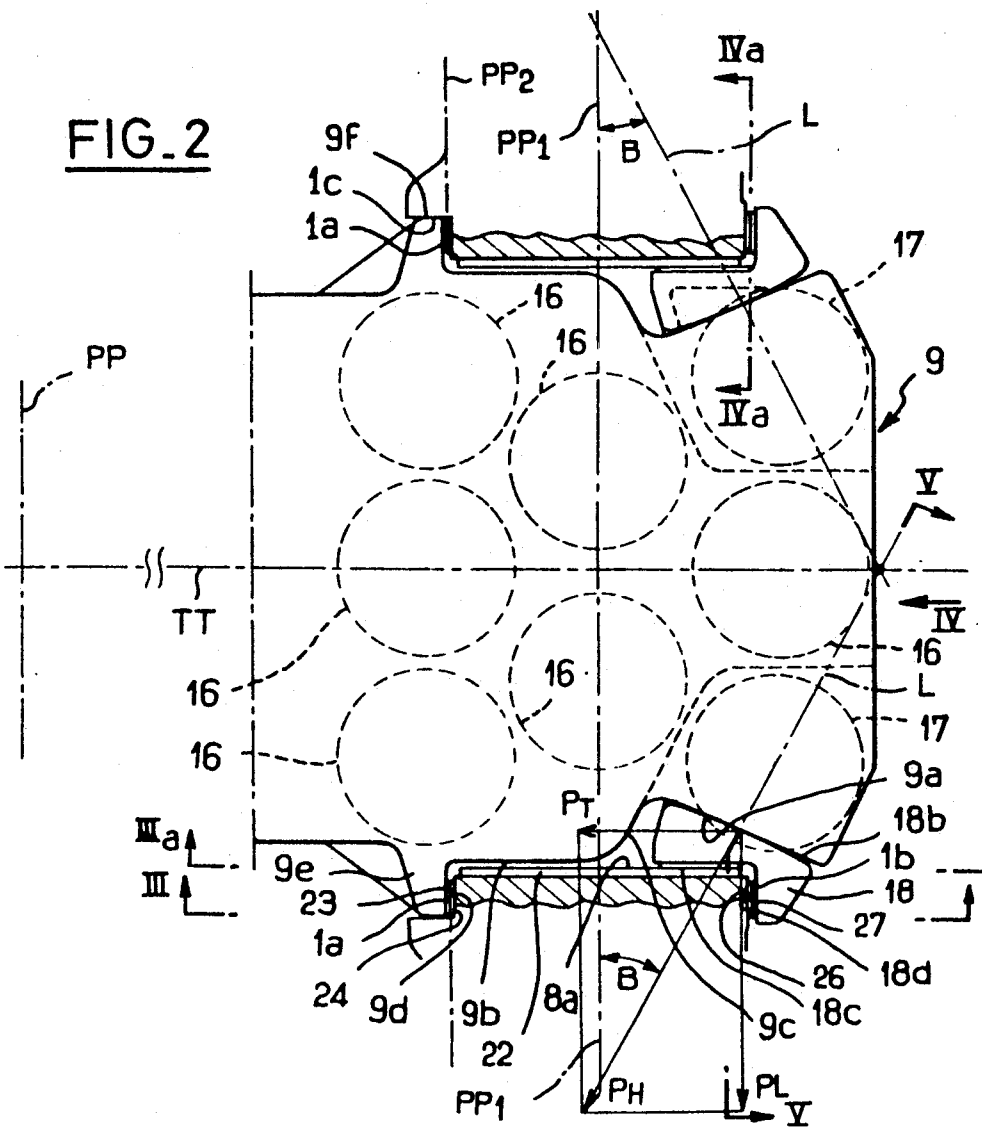
FIG. 2 is a top view of the deformable links between a transom end and one of the sole bars, in cross-section along the plane II—II in FIG. 3.

When the transom 11 is subjected to rotations relative to one or other of the sole bars 1, the bearing between the oblique faces 9*a* and 18*b* of the transom and of the wedges 18 respectively is modified slightly. The disadvantages which could result from this are minimized by the slightly convex shape of the oblique face 18*b* of the wedges 18, as shown in FIG. 2. In front of each oblique face 9*a* (FIG. 2), the transom end 9 has a longitudinal positioning face 9*b*, whose role will be explained later, which is situated opposite the lining 22 and has a small degree of play relative to the latter. The face 9*b* is situated between a shoulder 9*c* for connection to the oblique face 9*a*, and a reference face 9*d* which is parallel to the longitudinal mid plane PP of the bogie and which is carried by a lug 9*e* of the transom. The face 9*d* is defined by a friction lining 23 and it is intended to be in friction contact with a reference face la defined by a friction lining 24 fastened against an inner face of the sole bar 1 along the inner vertical edge of the cage 8.

In addition, as shown in FIG. 2, each vertical plane L orthogonally intersecting the oblique face 18*b* of a respective one of the wedges 18 and the adjacent oblique face 9*a* of the transom 9 forms an angle B with the longitudinal vertical mid plane PP of the bogie. In FIG. 2, this angle is illustrated relative to a plane PP1, parallel to the plane PP, for the purpose of reducing the cluttering of the figure. Each angle B is oriented such that the faces 9*a* and 18*b* converge with the plane TT towards the inside of the bogie when the latter is seen from above (FIG. 2).

The horizontal pressure $P_H$ to which each wedge 18 is subjected as a result of the mutual sliding bearing between the oblique faces 9*a* and 18*b* is thus in the vertical plane L and thus has two components, namely the above-mentioned component $P_L$ of the bearing of the friction face 18*c* against the friction face 8*a* and a component $P_T$ directed horizontally towards the plane PP and causing a friction bearing between two second friction faces 18*d* and 1*b* belonging to the wedge 18 and the sole bar 1 respectively. The faces 18*d* and 1*b* are parallel to the longitudinal mid plane PP of the bogie. The friction face 1*b* is defined by a friction lining 26 fastened against the outer face of the sole bar 1 along an outer vertical edge of the cage 8. The faces 1*a* and 1*b* are therefore opposite each other and situated on either side of the friction face 8*a*, along the corresponding vertical side of the cage 8. The face 18*d* is defined by a friction lining 27 fastened to the wedge 18. The friction faces 18*c* and 18*d* of the wedge 18 substantially form a concave orthogonal dihedron with a vertical ridge. The vertical plane L is therefore parallel to the ridge of the dihedron and it forms an angle with the two faces of the dihedron.

The component $P_T$ of the pressure $P_H$ thus stresses the sole bar 1 bearing by its reference face 1*a* against the reference face 9*d* of the transom 11.

In a more figurative manner, each wedge 18 functions like the movable jaw of a clamp which would clamp the sole bar 1 against the fixed jaw constituted by the lug 9*e* and more particularly by the reference face 9*d* of the latter.

At each transom end 9, the two reference faces 9*d* of the transom 11 are coplanar and the two reference faces 1*a* of the sole bar 1 are also coplanar. When at rest, these four faces are therefore in the same plane $PP_2$ (FIG. 2), and this plane is parallel to the plane PP. The longitudinal direction of the transom is then perpendicular to the longitudinal direction of the sole bar.

When this situation has been reached at the two ends of the transom, the two sole bars are parallel to each other and the transom is perpendicular to the running direction of the bogie. Consequently, neither of the two sole bars is in advance of the other. In other words, with respect to rocking motions, the underframe behaves like a rigid underframe.

The transverse pressure $P_T$ permanently tends to maintain this situation and the bogie consequently exhibits stability counter to the longitudinal movements of the sole bars relative to each other.

Each lug 9*e* ends in a stop face 9*f* which interacts with a stop shoulder 1*c* which each sole bar 1 has beyond the reference face 1*a*. The face 9*f* and the shoulder 1*c* are substantially parallel to the transverse mid plane TT of the bogie. One or other of these faces may, however, have, in cross-section in a plane parallel to the plane PP, a slightly convex profile in order to enable relative rotation of the sole bar and transom about the axis A (FIG. 4).

Figure 6:
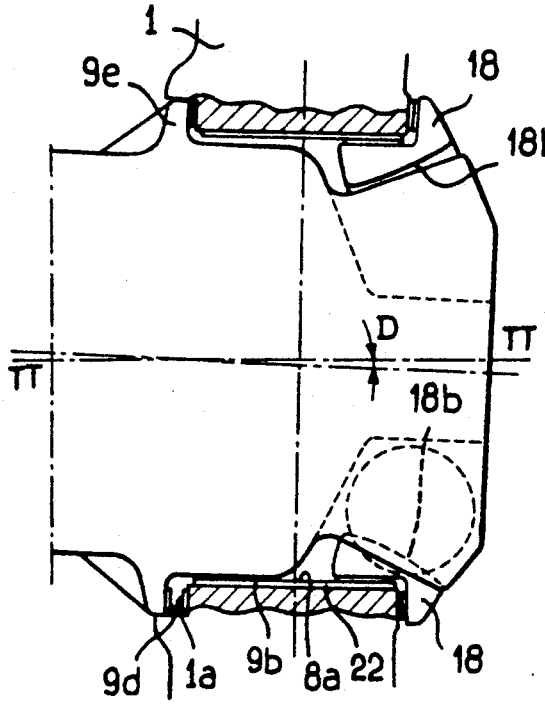
FIG. 6 is a view similar to FIG. 2 but illustrating a situation where the transom is misaligned relative to the sole bar.

As a result of the bearing contact of the two opposite faces 9*f* of each end 9 against the two opposite shoulders 1*c* of the associated sole bar 1, any rotation of the transom 11 in the horizontal plane relative to a sole bar 1 of necessity has as an axis a vertical axis adjacent to the plane $PP_2$ shown in FIG. 2. The situation in the event of such a rotation is shown in FIG. 6. One of the pairs of reference surfaces 1*a*, 9*d* is in the separated state, which has obliged the associated wedge 18 to sink with compression of the associated spring 17 (not shown in FIG. 6). This compression is not compensated by a corresponding relaxation of the other spring 17 associated with the other wedge 18 since, on the other side of the plane TT, the distance between the fixed jaw constituted by the lug 9*e* and the movable jaw constituted by the wedge 18 is virtually unaltered. The situation shown in FIG. 6 may therefore only result from running forces which exceed the stability forces generated by the structure according to the invention. Even in this case, the abovementioned stability forces limit the extent of the undesirable deformation. As shown in FIG. 6, the maximum angle D of relative rotation about the abovementioned axis is determined by the bearing of one or other of the faces 9*b* against the lining 22 of the sole bar 1.

The structure which has just been described considerably increases the friction forces capable of damping the vertical oscillations of the transom end relative to the associated sole bar. Indeed, for a given horizontal pressure $P_H$, which is a function of the force of the spring 17 and of the incline of the oblique faces 9*a*, 18*b*, the structure generates a friction subjected to a bearing force $P_L$ and a friction subjected to a bearing force $P_T$, the sum of the absolute values of $P_L$ and $P_T$ being greater than the absolute value of $P_H$, as shown in FIG. 2.

In all the embodiments which have just been described, each sole bar is prevented by stops 1*c*–9*f* from having a translational movement parallel to the running direction relative to the transom 11. In addition, stability forces oppose the pivoting of each sole bar 1 relative to the transom about a vertical axis. In these conditions, the sole bars 1 are permanently returned towards a relative position in which neither of them is in advance or behind the other. Consequently, the risks of the axles assuming undesirable orientations in the horizontal plane are minimized. The pressures directed lengthwise on the transom, which tend to separate the reference faces 1*a* and 9*d* of the sole bar and of the transom respectively are absorbed by the additional compression of the springs 17 placed under each wedge, in proportion to the inclination along the lines L of the faces 18*b* and 9*a* of the wedges and of the transom respectively. The structure according to the invention does not prevent the axles from assuming, if the deformable axlesole bar links allow it, convergent orientations in order to inscribe a curve under the action of specific forces exerted on the axles in this case, as is well known.

Figure 7:
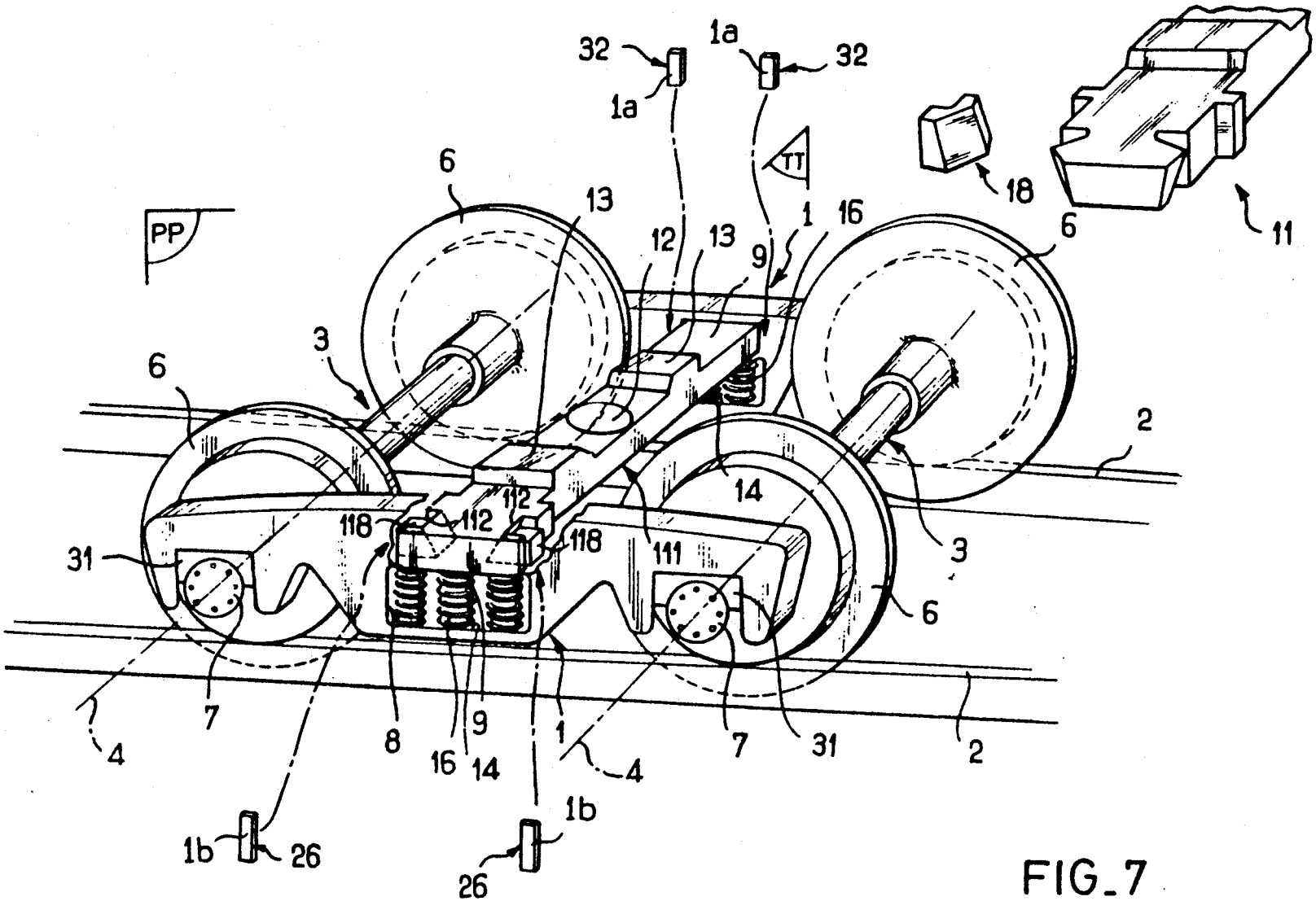
FIG. 7 is a schematic view of a prior bogie and of a set of interchangeable parts enabling the improvement method according to the invention to be applied to this bogie.

As shown in FIG. 7, the method according to the invention can be applied to a known bogie, such as, for example, that described in U.S. Pat. No. 4,084,514, initially comprising sole bars 1 with a cage 8 with a rectangular general shape, the axles 3 which have been described above, and a transom 111 comprising on each vertical side of each of its ends a housing 112. The base of the housing 112 is formed by an inclined face 113 which is so oriented that a vertical plane orthogonally intersecting inclined face 113 is parallel to the plane PP. Wedges 118, which have only a single bearing face transverse to the direction of the rails 2 and bearing against a corresponding vertical face of the cage 8 for their friction contact with the sole bar, are guided slidably in these housings. Such a bogie is not very stable since the sole bars are not returned towards a precise position relative to the transom.

In order to improve this bogie, the transom 111 and the wedges 118 need only be replaced by a transom 11 such as that described with reference to FIGS. 1 to 6 and by wedges 18 such as those described with reference to FIGS. 1 to 6, respectively. Prior to fitting these new elements, friction linings 26, intended to define the friction face 1*b* on the outer face of each sole bar along the vertical sides of the cage 8, and friction linings 32 intended to define the reference face 1*a* on the inner face of each sole bar along said vertical sides of the cages 8, are attached to the sole bars 1, which are preserved.

Figure 8:
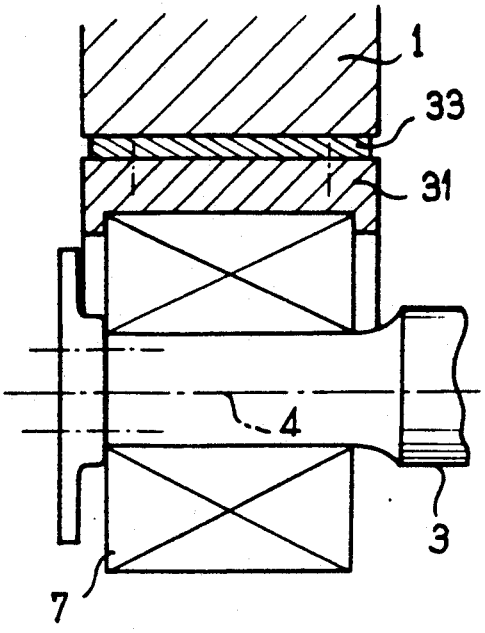
FIG. 8 is a view in axial cross-section of an axle-sole bar link.
Figure 9:
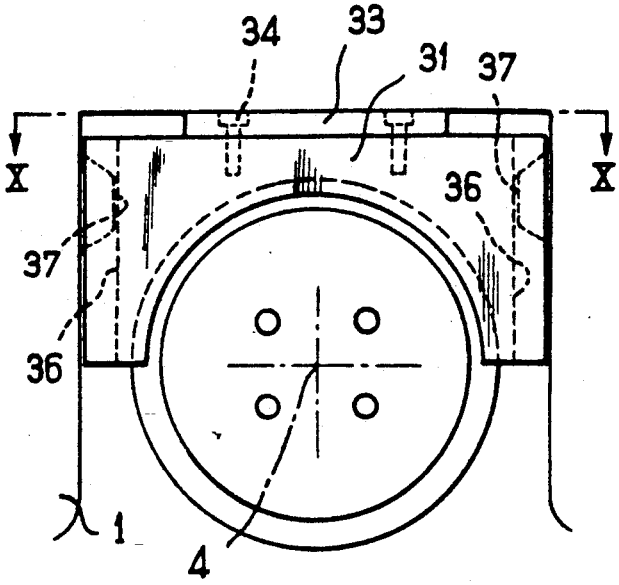
FIG. 9 is a front view of this link.
Figure 10:
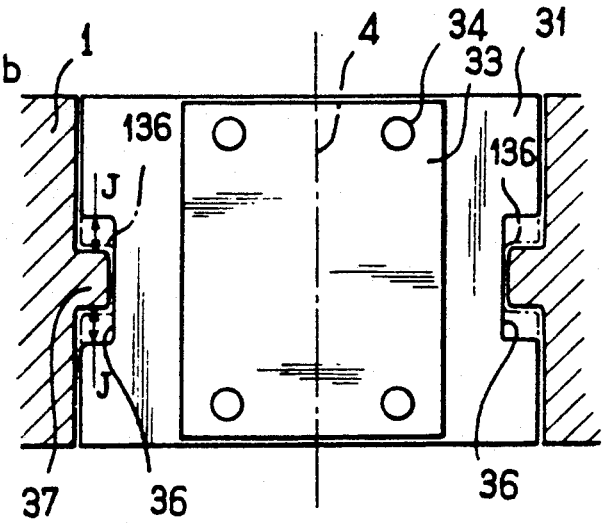
FIG. 10 is a view in cross-section along X—X in FIG. 9.

As shown in FIG. 8, each sole bar 1 rests on the bearing piece 31 via a block 33 relative to which the sole bar has a good coefficient of friction. The block 33 is fastened to the bearing piece by screws 34. The bearing piece 31 comprises vertical lateral grooves 36 (FIG. 10) receiving corresponding projections 37 of the sole bar 1. A degree of play 2J is provided between the projections 37 and the grooves 36, parallel to the axis 4, enabling axial clearance for the axle relative to the sole bar, this clearance, of the order of a few cm, being relatively free as a result of the sliding block 33. It has been found that in this way the axles no longer transmit certain destabilizing lateral forces to the sole bars, which enables the running speed to be further increased.

Within the scope of the improvement method, this feature can be achieved very simply since the initial grooves 136 (in dashed lines in FIG. 10) need only be enlarged and the sliding blocks 33 added to the upper face of the bearing pieces.

The invention is, of course, not limited to the examples described and shown.

In particular, the elastic means which stress the wedges such as 18 could bear against the transom instead of bearing against the sole bar, so as to have an action independent of the state of compression of the suspension springs.

The oblique faces of the wedge may interact with oblique faces of the sole bar, the first and second friction faces then being carried by the wedge and the transom. The angle B between the vertical plane L and the longitudinal vertical mid plane such as PP must, of course, be oriented such that a mutual bearing force results between the reference faces such as 1*a* and 9*d*.

I claim:

1. A bogie comprising two longitudinal elements, between which extend axles (3) and at least one transverse element, the transverse element (11) forming, at each of its ends (9) together with one of the longitudinal elements (1) and a wedge (18), a deformable link in which:

a lateral reference face (1*a*) belonging to the longitudinal element (1) is frictionally engageable with a mating reference face (9*d*) belonging to the transverse element (11), said lateral and mating reference faces being transverse to the longitudinal direction of the transverse element;

under the action of elastic means (17) urging the wedge upwardly, a first oblique face (18*b*) belonging to the wedge, bears against a corresponding second oblique face (9*a*) belonging to one (11) of the longitudinal (1) and transverse (11) elements of the link, wherein a vertical plane (L) orthogonally intersecting the first and the second oblique faces (18*b*, 9*a*) forms an angle (B) with a longitudinal midplane (PP) of the bogie, whereby:

the wedge is urged against the other of said longitudinal and transverse elements in a frictional engagement in which two vertical friction faces of the wedge, one of which is transverse to said longitudinal midplane (PP) of the bogie and the other of which is substantially parallel to said longitudinal midplane (PP) of the bogie, engage two corresponding vertical friction faces of said other of the longitudinal and transverse elements, and said one of the longitudinal and transverse elements is urged against said other of the longitudinal and transverse elements in frictional engagement between said lateral and mating reference faces.

2. The bogie as claimed in claim 1, wherein the reference faces (1*a*, 9*d*) are substantially parallel to the longitudinal mid plane (PP) of the bogie.

3. The bogie as claimed in claim 1, wherein said vertical friction faces of the wedge form a concave dihedron.

4. The bogie as claimed in claim 1, in which in each link, said vertical friction faces of said other of the longitudinal and transverse elements are friction faces of said longitudinal element (1), wherein a first (8*a*) of the friction faces of the longitudinal element (1) is formed on one side of a cage (8) of the longitudinal element (1), and wherein on said longitudinal element (1) said first friction face (8*a*) is between said lateral reference face (1*a*) and the other of the friction faces (1*b*) of the longitudinal element, said other friction face being turned in a direction opposed to said lateral reference face (1*a*).

5. The bogie as claimed in claim 4, in which said other friction face (1*b*) faces outwardly of the bogie.

6. The bogie as claimed in claim 1, in which two said deformable links are provided between each longitudinal element (1) and the corresponding end (9) of the transverse element (11), these two deformable links being symmetrical about a vertical midplane (TT) of the transverse element (11), whereby there is adjacent each end of the transverse element two said lateral reference faces (1*a*) belonging to one said longitudinal element (1) and two said mating reference faces (9*d*) belonging to the transverse element (11), and wherein said two lateral reference faces (1*a*) of each longitudinal element (1) are coplanar, and the two corresponding mating reference faces (9*d*) of the transverse element (11) are also coplanar.

7. The bogie as claimed in claim 1, wherein the angle (B) between the longitudinal mid plane (PP) and said vertical plane (L) orthogonally intersecting the oblique faces (18*b*, 9*a*) is approximately 25°.

8. The bogie as claimed in claim 1, wherein the longitudinal elements (1) rest upon bearings (7) of said axles via blocks (33), means (36, 37) being provided in order to give the axles (3) a predetermined degree of axial play relative to each longitudinal element (1).

9. A bogie comprising two longitudinal elements, between which extend axles (3) and at least one transverse element, the transverse element (11) forming, at each of its ends (9) together with one of the longitudinal elements (1) two deformable links which are symmetrical about a vertical midplane (TT) of the transverse element, wherein, in each said deformable link:

a lateral reference face (1*a*) belonging to the longitudinal element (1) is frictionally engageable with a mating reference face (9*d*) belonging to the transverse element (11), said lateral and mating reference faces being transverse to the longitudinal direction of the transverse element, elastic means (17) urging upwardly a respective wedge of each deformable link, whereby a first oblique face (18*b*) belonging to the wedge bears against a corresponding second oblique face (9*a*) belonging to one (11) of the longitudinal (1) and transverse (11) elements of the link, wherein a vertical plane (L) orthogonally intersecting the first and the second oblique faces (18*b*, 9*a*) forms an angle (B) with a longitudinal midplane (PP) of the bogie, whereby:

the wedge is urged against the other of said longitudinal and transverse elements in a frictional engagement in which two vertical friction faces of the wedge, one of which is transverse to said longitudinal midplane (PP) of the bogie and the other of which is substantially parallel to said longitudinal midplane (PP) of the bogie, engage two corresponding vertical friction faces of said other of the longitudinal and transverse elements is urged against said other of the longitudinal and transverse elements in frictional engagement between said lateral and mating reference faces;

there being adjacent each end of the transverse element two said lateral reference faces (1*a*) which belong to one said longitudinal element (1) and are coplanar and two said mating reference faces (9*d*) which belong to the transverse element (11) and are also coplanar.

* * * * *